US010201236B1

(12) United States Patent
Cloud

(10) Patent No.: US 10,201,236 B1
(45) Date of Patent: Feb. 12, 2019

(54) INFANT SOOTHING SYSTEM

(71) Applicant: Deborah Cloud, Englewood, NJ (US)

(72) Inventor: Deborah Cloud, Englewood, NJ (US)

( * ) Notice: Subject to any disclaimer, the term of this patent is extended or adjusted under 35 U.S.C. 154(b) by 388 days.

(21) Appl. No.: 15/132,374

(22) Filed: Apr. 19, 2016

(51) Int. Cl.

| | |
|---|---|
| ***A47D 13/08*** | (2006.01) |
| ***H04R 1/02*** | (2006.01) |
| ***A47D 15/00*** | (2006.01) |
| *A47G 9/00* | (2006.01) |

(52) U.S. Cl.
CPC ..... *A47D 13/08* (2013.01); *A47D 15/00* (2013.01); *H04R 1/025* (2013.01); *A47G 2009/006* (2013.01)

(58) Field of Classification Search
CPC ..... A47D 13/08; A47D 13/00; A47D 15/00; A47D 15/001; A47D 15/003; H04R 1/025; A47G 9/00; A47G 2009/006
See application file for complete search history.

(56) References Cited

U.S. PATENT DOCUMENTS

| | | | | | |
|---|---|---|---|---|---|
| 3,419,923 | A * | 1/1969 | Cowan | A47D 9/02 | 5/109 |
| 4,066,072 | A * | 1/1978 | Cummins | A47C 27/085 | 128/903 |
| 4,088,124 | A * | 5/1978 | Korner | A61H 1/001 | 5/674 |
| 4,730,604 | A * | 3/1988 | Boggs | A61H 23/04 | 5/655 |
| 4,934,997 | A * | 6/1990 | Skakas | A47D 7/04 | 5/101 |
| 5,816,910 | A * | 10/1998 | Steele | A61M 21/00 | 454/370 |
| 6,513,164 | B1 * | 2/2003 | Hearns | A41B 13/06 | 2/69.5 |
| 6,968,806 | B2 * | 11/2005 | Helwig | A01K 1/0353 | 119/28.5 |
| 7,475,441 | B1 * | 1/2009 | Soberal | A47D 9/02 | 5/634 |
| 7,895,692 | B1 | 3/2011 | Najafi | | |
| 8,082,615 | B1 * | 12/2011 | Alkhattaf | A47C 21/003 | 5/655 |
| 8,127,384 | B2 | 3/2012 | Carlton | | |
| 8,220,089 | B1 * | 7/2012 | Diefenbach | A47D 9/02 | 5/655 |
| D699,217 | S | 2/2014 | McCoy | | |
| 8,769,737 | B1 | 7/2014 | Duggins | | |
| 9,357,855 | B2 * | 6/2016 | Gersin | A47C 21/006 | |
| 2002/0120176 | A1 * | 8/2002 | Coviello | A47G 9/0223 | 600/28 |
| 2006/0010604 | A1 * | 1/2006 | Kamrin-Balfour | A47C 7/72 | 5/655 |

(Continued)

*Primary Examiner* — Eric J Kurilla
*Assistant Examiner* — David R Hare

(57) ABSTRACT

The infant soothing system is adapted for use with infants. The infant soothing system is a cushion or pillow that that simulates the breathing and heartbeat patterns of a mother. The infant is placed upon the infant soothing system during rest periods during which a bladder contained within the infant soothing system inflates and deflates to simulate the breathing pattern. One or more speakers located within the infant soothing system generate an audible sound that simulates the heartbeat pattern. The infant soothing system comprises a bladder, a base, a pressure system, a sound system, and a control system.

10 Claims, 4 Drawing Sheets

(56) References Cited

U.S. PATENT DOCUMENTS

| | | | | |
|---|---|---|---|---|
| 2008/0201855 | A1* | 8/2008 | Groves | A47D 5/006 5/655 |
| 2009/0089928 | A1* | 4/2009 | Kasbohm | A47G 9/0207 5/485 |
| 2011/0144416 | A1 | 6/2011 | Waddell | |
| 2014/0066692 | A1 | 3/2014 | Monros | |
| 2014/0082839 | A1 | 3/2014 | Piombino | |
| 2014/0259359 | A1* | 9/2014 | Yaari | A47K 3/064 4/546 |
| 2016/0286982 | A1* | 10/2016 | Smith | A47D 15/008 |

* cited by examiner

INFANT SOOTHING SYSTEM

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture or domestic articles adapted especially for children, more specifically, an oscillating cushion adapted for use by an infant.

SUMMARY OF INVENTION

The infant soothing system is adapted for use with infants. The infant soothing system is a cushion or pillow that that simulates the breathing and heartbeat patterns of a mother. The infant is placed upon the infant soothing system during rest periods during which a bladder contained within the infant soothing system inflates and deflates to simulate the breathing pattern. One or more speakers located within the infant soothing system generates an audible sound that simulates the heartbeat pattern. In alternative embodiments of the disclosure, other sounds are generated by the infant soothing system.

These together with additional objects, features and advantages of the infant soothing system will be readily apparent to those of ordinary skill in the art upon reading the following detailed description of the presently preferred, but nonetheless illustrative, embodiments when taken in conjunction with the accompanying drawings.

In this respect, before explaining the current embodiments of the infant soothing system in detail, it is to be understood that the infant soothing system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the infant soothing system.

It is therefore important that the claims be regarded as including such equivalent construction insofar as they do not depart from the spirit and scope of the infant soothing system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
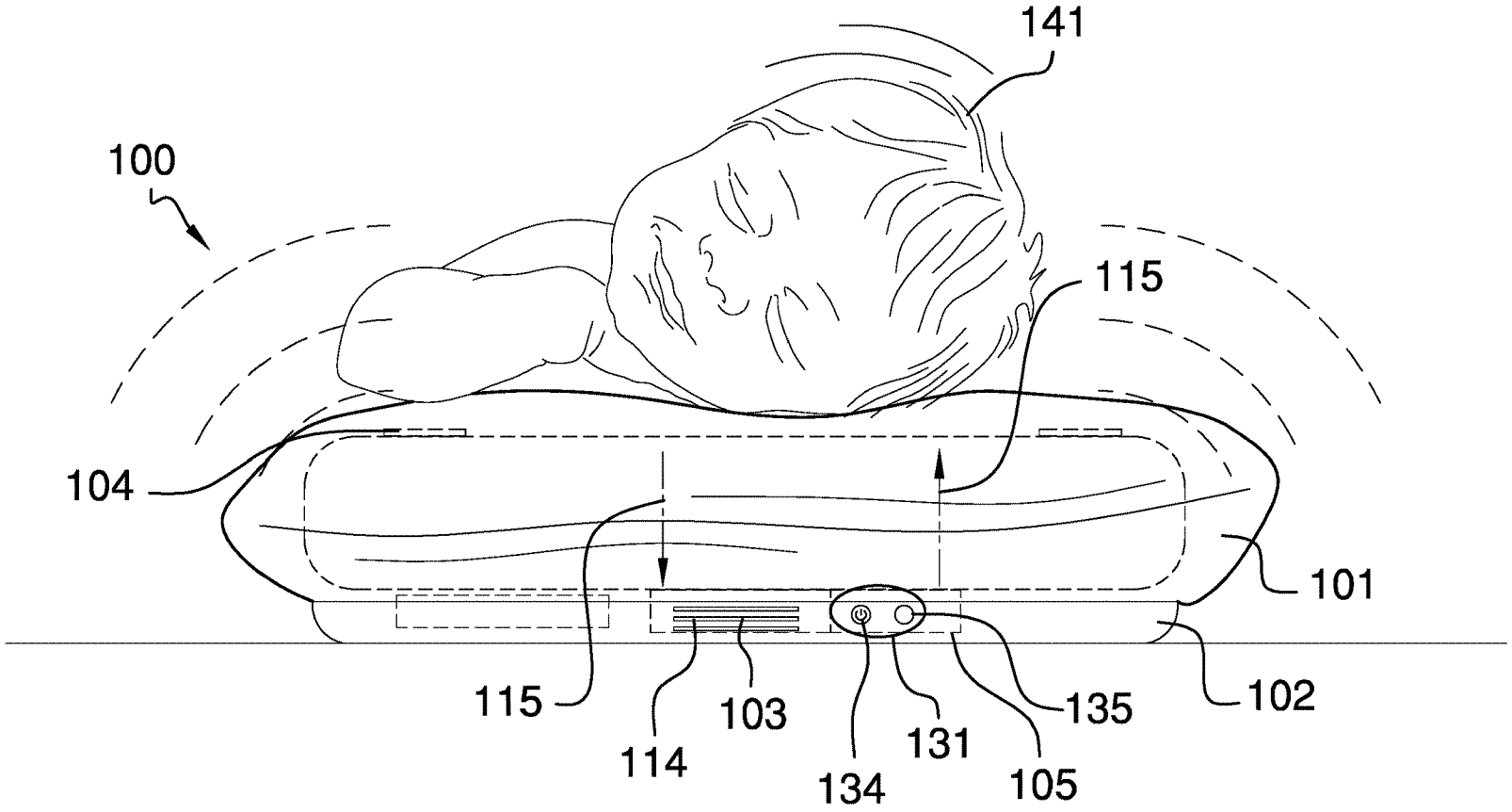
FIG. 1 is an in use view of an embodiment of the disclosure.
Figure 2:
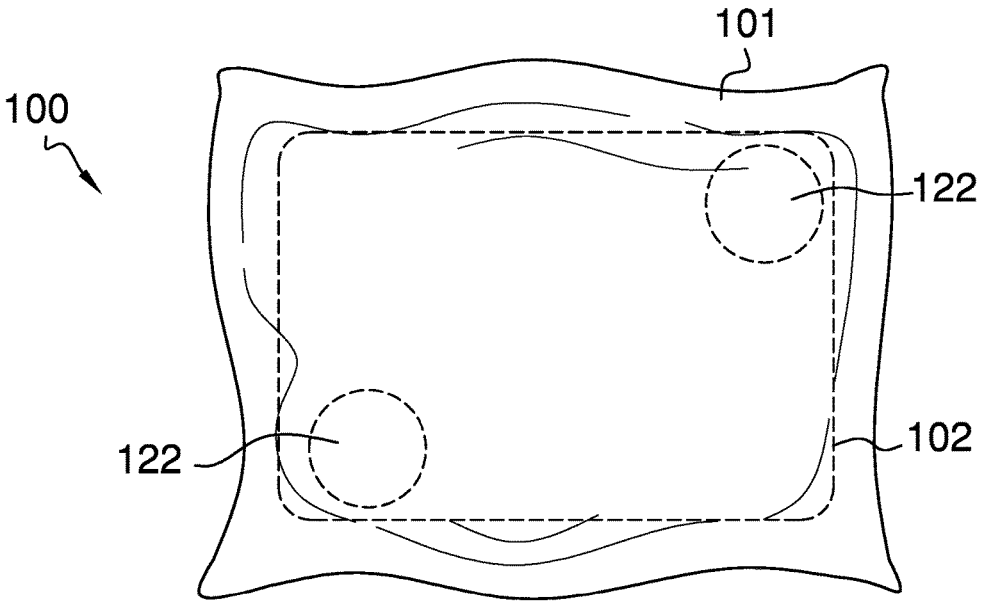
FIG. 2 is a top view of an embodiment of the disclosure.
Figure 3:
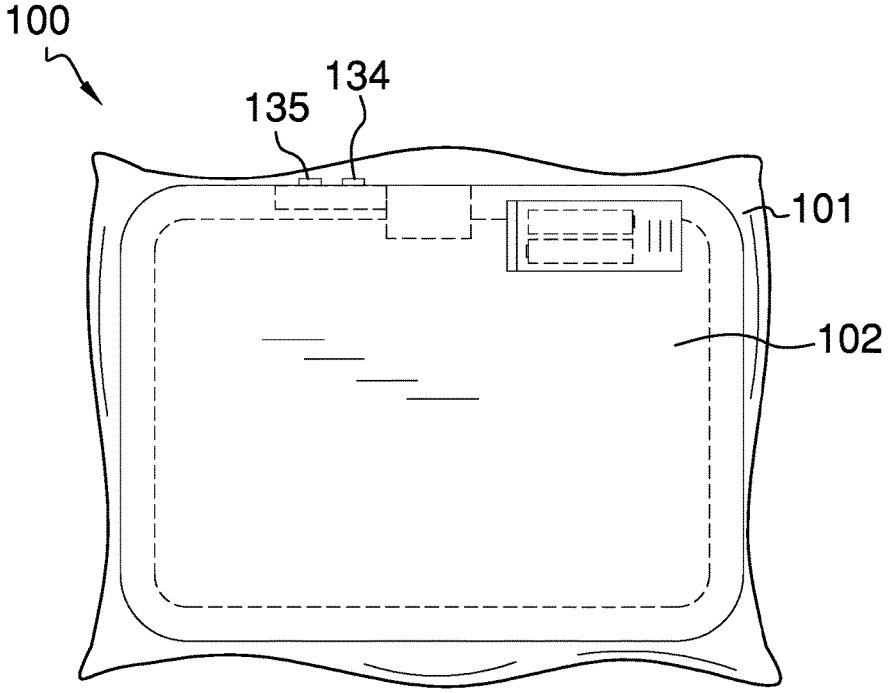
FIG. 3 is a bottom view of an embodiment of the disclosure.
Figure 4:
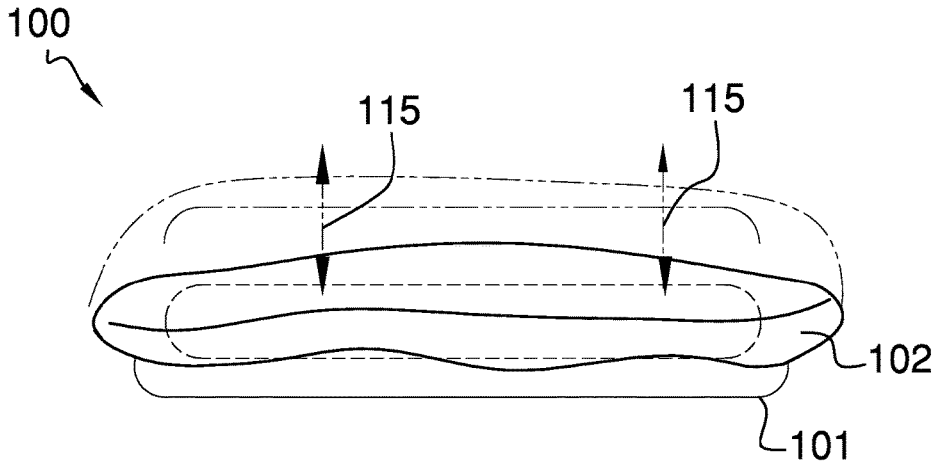
FIG. 4 is a side view of an embodiment of the disclosure.
Figure 5:
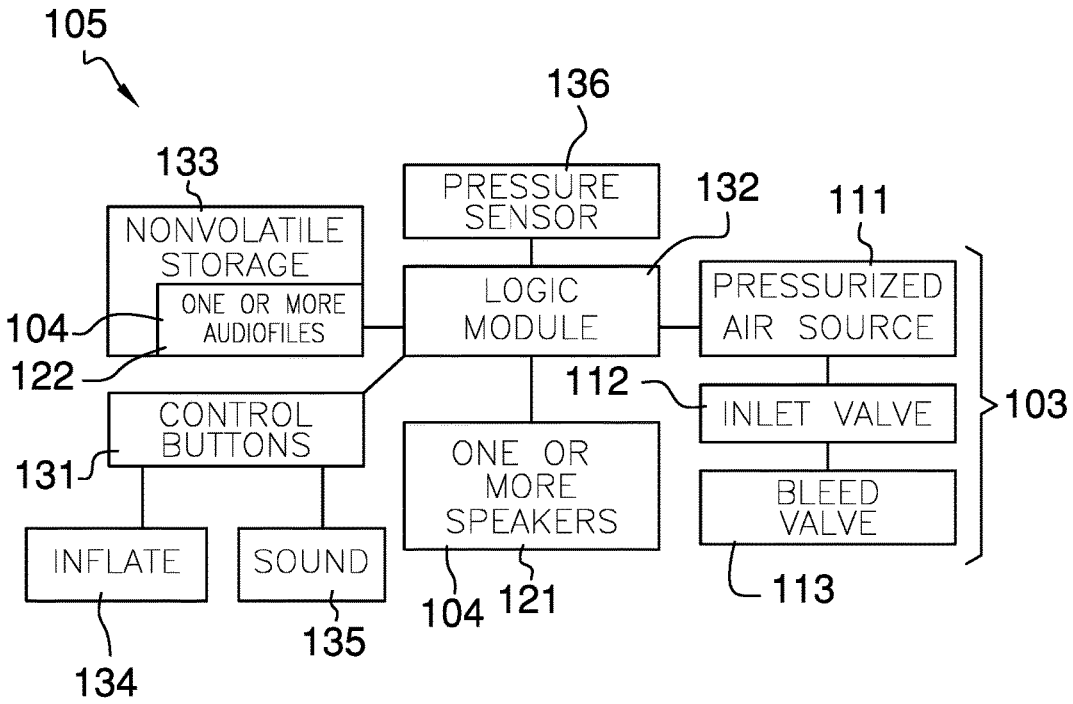
FIG. 5 is a block diagram of an embodiment of the disclosure.
Figure 6:
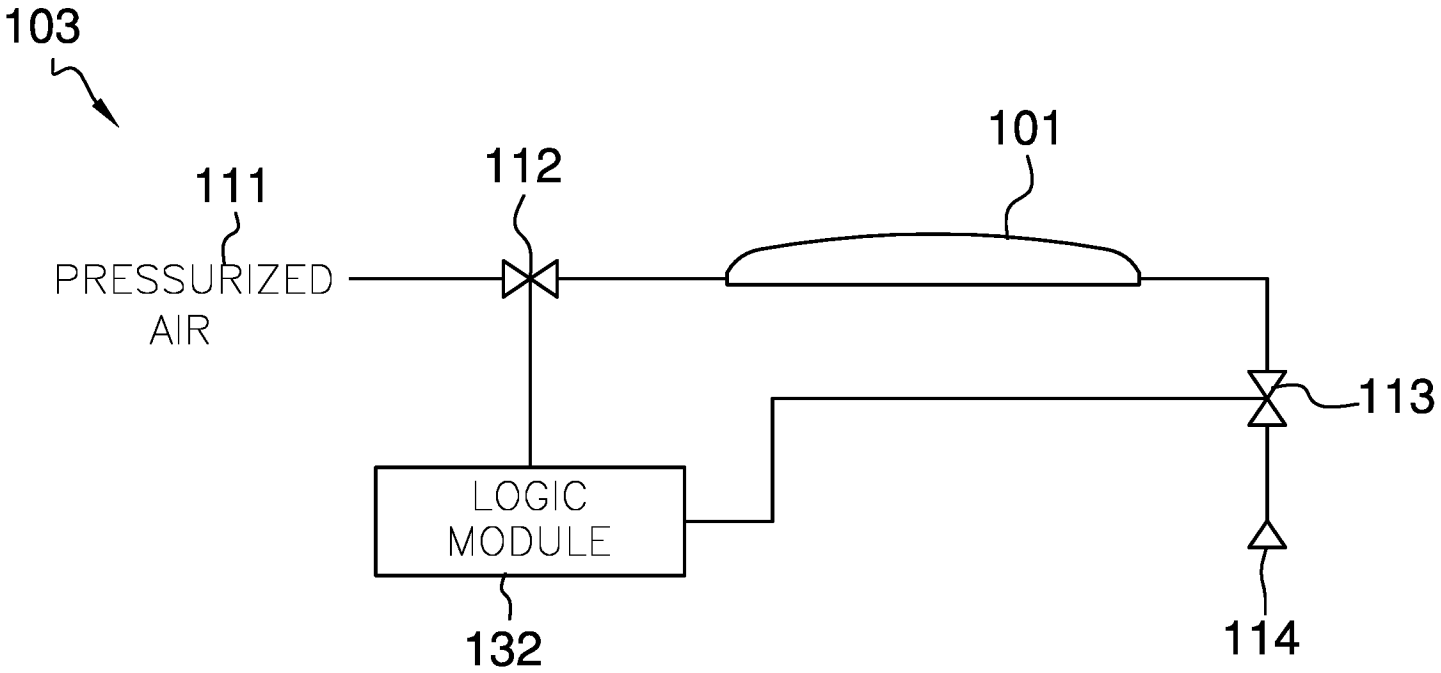
FIG. 6 is a schematic of an embodiment of the disclosure.

Detailed reference will now be made to one or more potential embodiment of the disclosure, which are illustrated in FIGS. 1 through 6.

The infant soothing system 100 (hereinafter invention) comprises a bladder 101, a base 102, a pressure system 103, a sound system 104, and a control system 105. The invention 100 is adapted for use with an infant 141. The invention 100 is a cushion or pillow that that simulates the breathing and heartbeat patterns of a mother. The infant 141 is placed upon the invention 100 during rest periods during which a bladder 101 contained within the invention 100 inflates and deflates to simulate the breathing pattern. The invention 100 also generates an audible sound that simulates the heartbeat pattern. Alternatively, other sounds can be generated by the invention 100.

The bladder 101 is an inflatable structure that is used as a cushion. When an infant 141 is placed on the inflated bladder 101, the compression of the air captured within the bladder 101 acts as a cushion which provides the infant 141 a comfortable surface upon which to rest. During operation of the invention 100, the control system 105 increases and decreases the pressure of the air captured within the bladder 101 to raise and lower 115 the bladder 101 thereby emulating the breathing pattern of a mother. The inflated shape of the bladder 101 can be rectangular or, optionally, can be formed in the shape of an animal, toy or other decorative image for aesthetic purposes.

The base 102 is a rigid rectangular housing upon which the bladder 101 is attached. Contained within the base 102 is stored the pressure system 103, the sound system 104, and the control system 105.

The pressure system 103 further comprises a pressurized air source 111, an inlet valve 112, a bleed valve 113, and a vent 114. The pressurized air source 111 is a physical source for the pressurized air that is used to inflate the bladder 101. In the first potential embodiment of the disclosure, a commercially available air pump is used as the pressurized air source 111. In the second potential embodiment of the disclosure, a commercially available canister of compressed air is the pressurized air source 111. Pressurized air from the pressurized air source 111 is introduced into the bladder 101 through the inlet valve 112. The inlet valve 112 is a solenoid valve that is controlled by the control system 105. Air captured within the bladder 101 is released from the bladder 101 through the bleed valve 113. The bleed valve 113 is a solenoid valve that is controlled by the control system 105. The bleed valve 113 routes air released from the bladder 101 to the vent 114. The vent 114 releases air flow from the bladder 101 to the atmosphere.

The sound system 104 further comprises one or more speakers 121 and one or more audio files 122. The one or more speakers 121 are readily and commercially available speakers. Each of the one or more audio files 122 is a previously prepared audio file that contains a digital representation of an audible sound that will be played through the one or more speakers 121. One audio file contained in the one or more audio file will always contain a digital representation of the audible sound of a heartbeat. The one or more speakers 121 are mounted within the base 102 such that sounds generated by the one or more speakers are audible to the infant 141.

The control system 105 further comprises a plurality of control switches 131, a logic module 132, a nonvolatile storage device 133, and a pressure sensor 136. Each of the plurality of control switches 131 is monitored by the logic module 132 and are used to provide control signals for use as an interface between the user and the logic module 132. The plurality of control switches 131 further comprises an inflate switch 134 and a sound switch 135. The logic module 132 is a commercially available programmable device that is used to control and operate the invention 100. Depending on the specific design and the selected components, the logic module 132 can be a separate component within the invention 100 or the functions of the logic module 132 can be incorporated into another component of the invention 100.

In all potential embodiments described in this disclosure, the logic module 132 and the nonvolatile storage device 133 are provisioned as a single Arduino device with the associated shields. The nonvolatile storage device 133 is a commercially available storage device that: 1) is used to store the one or more audio files 122; and, 2) is accessible by the logic module 132 such that the logic module 132 can retrieve the one or more audio files 122 for further processing. The pressure sensor 136 is a commercially available pressure sensor that is monitored by the logic module 132. In all potential embodiments described in this disclosure, the pressure sensor 136 is provisioned as an Arduino shield.

The operation of the invention 100 is as follows in this paragraph and the next two paragraphs. When the sound switch 135 is closed, the logic module 132 retrieves a predetermined audio file selected from the one or more audio files 122 stored in the nonvolatile storage device 133. The logic module 132 decodes the audio file and generates an audio signal that is transmitted to the one or more speakers 121 for announcement. When the sound switch 135 is opened the logic module 132 discontinues the operation described in this paragraph. Methods to code audible sounds into audio files, decode audible sounds from audio files, and generate audio signals for speakers are well known and documented in the electrical arts.

When the inflate switch 134 is closed, the logic module 132 activates (if necessary) the pressurized air source 111 and sends a control signal to open the inlet valve 112. The inlet valve 112 remains open until a first predetermined air pressure registers on the pressure sensor 136. When the logic module 132 determines that the first predetermined air pressure has registered on the pressure sensor 136, the logic module 132 closes the inlet valve 112 and implements a delay by starting a first countdown timer. When the first countdown timer times out, the logic module 132 sends a control signal to open the bleed valve 113. The bleed valve 113 remains open until a second predetermined air pressure registers on the pressure sensor 136. When the logic module 132 determines that the second predetermined air pressure has registered on the pressure sensor 136, the logic module 132 closes the bleed valve 113 and implements a delay by starting a second countdown timer. When the second countdown timer times out, the logic module 132 restarts the cycle by sending a control signal to open the inlet valve 112.

The cycle described in the last paragraph continues until the inflate switch 134 is opened. On this occurrence, the logic module 132 opens the bleed valve 113, deactivates (if necessary) the pressurized air source 111 and discontinues the operations as described in this paragraph and the previous paragraph.

The following definitions were used in this disclosure:

Audio File: As used in this disclosure, an audio file is a digital representation of a sound that is used to store a recording of the sound.

Audio Source: As used in this disclosure, an audio source is a device that generates electrical signals that can be converted in to audible sounds by a speaker.

Housing: As used in this disclosure, a housing is a rigid casing that encloses and protects one or more devices.

Logic Module: As used in this disclosure, a logic module is a programmable device that accepts digital and analog inputs, processes the digital and analog inputs according to previously stored instruction and to provide the results of these instructions as digital or analog outputs.

Sensor: As used in this disclosure, a sensor is a device that receives and responds in a predetermined way to a signal or stimulus.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port.

Speaker: As used in this disclosure, a speaker is an electrical device that converts an electrical signal into an audible sound.

Switch: As used in this disclosure, a switch is an electrical device that starts and stops the flow of electricity through an electric circuit.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An oscillating cushion comprising:

a bladder, a base, a pressure system, a sound system, and a control system;

wherein the oscillating cushion is adapted for use with an infant;

wherein the oscillating cushion simulates a breathing pattern;

wherein the oscillating cushion simulates a heartbeat pattern;

wherein the bladder inflates and deflates to simulate the breathing pattern;

wherein the oscillating cushion generates an audible sound to simulate the heartbeat pattern;

wherein the bladder is an inflatable structure;

wherein the base is a rigid housing;

wherein the bladder is attached to the base;

wherein the pressure system, the sound system; and the control system are contained by the base;

wherein the pressure system further comprises a pressurized air source, an inlet valve, a bleed valve, and a vent;

wherein the inlet valve connects the pressurized air source and the bladder;

wherein the bleed valve connects the bladder to the vent;

wherein the vent releases air to the atmosphere;

wherein the inlet valve is a solenoid valve;

wherein the inlet valve is installed such that the operation of the inlet valve is controlled by a logic module;

wherein the bleed valve is a solenoid valve;

wherein the bleed valve is installed such that the operation of the bleed valve is controlled by the logic module;

wherein the sound system further comprises one or more speakers and one or more audio files;

wherein each of the one or more speakers is connected to the control system;

wherein each of the one or more audio files is stored by the control system;

wherein each of the one or more audio files is a previously prepared audio file that contains a digital representation of an audible sound;

wherein at least one audio file selected from the one or more audio file contains the digital representation of the audible sound of a heartbeat;

wherein the one or more speakers are mounted within the base such that sounds generated by the one or more speakers are audible to the infant;

wherein the control system further comprises a plurality of control switches, the logic module, a nonvolatile storage device, and a pressure sensor;

wherein the plurality of control switches, the nonvolatile storage device and the pressure sensor are connected to the logic module.

2. The oscillating cushion according to claim 1 wherein the pressurized air source is a pump;

wherein the pressurized air source provides the air that is used to inflate the bladder.

3. The oscillating cushion according to claim 1 wherein the pressurized air source is a canister of compressed air;

wherein the pressurized air source provides the air that is used to inflate the bladder.

4. The oscillating cushion according to claim 1 wherein the logic module is a programmable device.

5. The oscillating cushion according to claim 4 wherein each of the plurality of control switches is monitored by the logic module;

wherein each of the plurality of control switches provide control signals for use the logic module;

wherein the plurality of control switches further comprises an inflate switch and a sound switch.

6. The oscillating cushion according to claim 5 wherein the nonvolatile storage device is used to store the one or more audio files;

wherein the nonvolatile storage device is accessible by the logic module such that the logic module can retrieve the one or more audio files for further processing.

7. The oscillating cushion according to claim 6 wherein the pressure sensor is monitored by the logic module.

8. The oscillating cushion according to claim 1 wherein the logic module is a programmable device;

wherein each of the plurality of control switches is monitored by the logic module;

wherein each of the plurality of control switches provide control signals for use by the logic module;

wherein the plurality of control switches further comprises an inflate switch and a sound switch;

wherein the nonvolatile storage device is used to store the one or more audio files;

wherein the nonvolatile storage device is accessible by the logic module such that the logic module can retrieve the one or more audio files for further processing;

wherein the pressure sensor is monitored by the logic module;

wherein the logic module sends a control signal to open the inlet valve;

wherein when the logic module determines that the first predetermined air pressure has registered on the pressure sensor the logic module closes the inlet valve and implements a delay by starting a first countdown timer;

wherein when first countdown timer times out the logic module sends a control signal to open the bleed valve;

wherein when the logic module determines that the second predetermined air pressure has registered on the pressure sensor the logic module closes the bleed valve and implements a delay by starting a second countdown timer;

wherein the logic module opens and closes the inlet valve in a cyclic pattern; wherein the logic module opens and closes the bleed valve in a cyclic pattern.

9. The oscillating cushion according to claim 1 wherein the logic module is a programmable device;

wherein each of the plurality of control switches is monitored by the logic module;

wherein each of the plurality of control switches provide control signals for use b the logic module;

wherein the plurality of control switches further comprises an inflate switch and a sound switch;

wherein the nonvolatile storage device is used to store the one or more audio files;

wherein the nonvolatile storage device is accessible by the logic module such that the logic module can retrieve the one or more audio files for further processing;

wherein the pressure sensor is monitored by the logic module;

wherein the logic module retrieves a predetermined audio file selected from the one or more audio files stored in the nonvolatile storage device;

wherein the logic module decodes the audio file and generates an audio signal that is transmitted to the one or more speakers for announcement.

10. The oscillating cushion according to claim 1 wherein the logic module is a programmable device;

wherein each of the plurality of control switches is monitored by the logic module;

wherein each of the plurality of control switches provide control signals for use by the logic module;

wherein the plurality of control switches further comprises an inflate switch and a sound switch;

wherein the nonvolatile storage device is used to store the one or more audio files;

wherein the nonvolatile storage device is accessible by the logic module such that the logic module can retrieve the one or more audio files for further processing;

wherein the pressure sensor is monitored by the logic module;

wherein the logic module retrieves a predetermined audio file selected from the one or more audio files stored in the nonvolatile storage device; wherein the logic module decodes the audio file and generates an audio signal that is transmitted to the one or more speakers for announcement;

wherein the logic module sends a control signal to open the inlet valve; wherein when the logic module determines that the first predetermined air pressure has registered on the pressure sensor the logic module closes the inlet valve and implements a delay by starting a first countdown timer;

wherein when first countdown timer times out the logic module sends a control signal to open the bleed valve; wherein when the logic module determines that the second predetermined air pressure has registered on the pressure sensor the logic module closes the bleed valve and implements a delay by starting a second countdown timer;

wherein the logic module opens and closes the inlet valve in a cyclic pattern;

wherein the logic module opens and closes the bleed valve in a cyclic pattern.

* * * * *